US006708801B2

(12) United States Patent
Nakai

(10) Patent No.: US 6,708,801 B2
(45) Date of Patent: Mar. 23, 2004

(54) GROUP CONTROLLED ELEVATOR CONTROL SYSTEM FOR CONTROLLING A PLURALITY OF ELEVATORS

(75) Inventor: Shoji Nakai, Hachioji (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/048,248

(22) PCT Filed: May 29, 2001

(86) PCT No.: PCT/JP01/04502

§ 371 (c)(1),
(2), (4) Date: Jan. 29, 2002

(87) PCT Pub. No.: WO01/92139

PCT Pub. Date: Dec. 6, 2001

(65) Prior Publication Data

US 2002/0112923 A1 Aug. 22, 2002

(30) Foreign Application Priority Data

May 29, 2000 (JP) ..... 2000-158313

(51) Int. Cl.[7] ..... B66B 1/18
(52) U.S. Cl. ..... 187/382; 187/247
(58) Field of Search ..... 187/380, 382, 187/383, 387, 388, 247

(56) References Cited

U.S. PATENT DOCUMENTS 4,860,207 A * 8/1989 Kubo ..... 187/247
5,202,540 A * 4/1993 Auer et al. ..... 187/247
5,808,247 A 9/1998 Thangavelu
5,817,994 A * 10/1998 Fried et al. ..... 187/391
5,854,454 A * 12/1998 Upender et al. ..... 187/247
5,932,852 A * 8/1999 Tyni et al. ..... 187/382
5,936,211 A * 8/1999 Kim ..... 187/248
5,955,708 A * 9/1999 Amano et al. ..... 187/247
6,325,178 B2 * 12/2001 Hikita et al. ..... 187/382
6,349,795 B1 * 2/2002 Tatsumi et al. ..... 187/247
6,471,011 B1 * 10/2002 Ando et al. ..... 187/247
2001/0002636 A1 * 6/2001 Siikonen ..... 187/382

FOREIGN PATENT DOCUMENTS

| | | |
|---|---|---|
| EP | 0870717 | 10/1998 |
| JP | 58-157683 | 9/1983 |
| JP | 4-55272 | 2/1992 |
| JP | 5-147837 | 6/1993 |
| JP | 09-151043 | 6/1997 |
| JP | 97-151043 | 6/1997 |
| JP | 9-208145 | 8/1997 |
| JP | 9-208145 A | 8/1997 |
| JP | 2001-335249 | 12/2001 |
| WO | WO 97/19878 | 6/1997 |
| WO | WO 98/18708 | 5/1998 |
| WO | WO 01/92139 A1 | 6/2001 |

* cited by examiner

*Primary Examiner*—Jonathan Salata
(74) *Attorney, Agent, or Firm*—Finnegan, Henderson, Farabow, Garrett & Dunner, L.L.P.

(57) ABSTRACT

A control system for a group of elevators capable of forming a controlled group of elevators by connecting platform call input/output units and operation control units for each floor to each other via a transmission line system. Platform call input/output units and operation control units are connected to each other via transmission lines of every elevator. All of the operation control units and a group control unit are connected to each other via a transmission line, so that the platform call input/output units are disconnected from the group control unit.

8 Claims, 14 Drawing Sheets

GROUP CONTROLLED ELEVATOR CONTROL SYSTEM FOR CONTROLLING A PLURALITY OF ELEVATORS

BACKGROUND OF THE INVENTION

1. Field of The Invention

The present invention relates generally to a control system for group controlled elevators. More specifically, the invention relates to a group controlled elevator control system for controlling the operation of a plurality of elevators when the elevators are running between a plurality of floors.

2. Description of The Prior Art

As a conventional control system for group controlled elevators, there is known a system in which platform call input/output units provided on the respective floors are connected directly to a group control system via transmission lines. When the group control system detects a registered platform call, the group control system outputs a platform call button lighting signal to the platform call input/output unit and outputs an assignment control signal to an operation control unit, to cause the elevators to respond to the registered platform call.

As another conventional control system for group controlled elevators, there is a system described in Japanese Patent Laid-Open No. 1997-151043. FIG. 16 schematically shows this control system for group controlled elevators.

This conventional control system for group controlled elevators is used for controlling the operation of two elevators from the first floor to the n-th floor. Reference numbers 101 and 102 denote operation control units for controlling the respective elevators. Reference numbers 104 and 105 are platform control units which are provided on the respective floors from the first floor to the n-th floor, respectively. The platform control units $\mathbf{104}_1$ through $\mathbf{104}_n$ and $\mathbf{105}_1$ through $\mathbf{105}_n$ for the respective floors are connected to each other via a platform transmission relay unit 114 and a platform transmission line 116. The platform control units $\mathbf{104}_1$ through $\mathbf{104}_n$ and $\mathbf{105}_1$ through $\mathbf{105}_n$ for the respective floors are provided with platform call buttons 108*a* through 108*na*, respectively. A platform data, such as a platform call signal, is transmitted to the platform transmission relay unit 114 via the platform transmission line 116, and transmitted from the platform transmission relay unit 114 to a corresponding one of the control units 101 and 102 for the respective elevators via a corresponding one of transmission lines 117 and 118 for the respective elevators. A control data transmitted from the operation control unit 101 is transmitted from the transmission lines 117 and 118 for the respective elevators to the platform control units $\mathbf{104}_1$ through $\mathbf{104}_n$ and $\mathbf{105}_1$ through $\mathbf{105}_n$ for the respective floors via the platform transmission relay unit 114 and platform transmission line 116.

A group control unit 110 is connected to the respective operation control units 101 and 102 via group control transmission lines 121 and 122, respectively, and connected to the platform transmission relay unit 114 via a transmission line 115. The platform transmission relay unit 114 includes a transmission protocol converter for converting one of protocols into the other protocol in order to adjust a transmission protocol between the respective operation control units 101 and 102 and the platform control units $\mathbf{104}_1$ through $\mathbf{104}_n$ and $\mathbf{105}_1$ through $\mathbf{105}_n$ for the respective floors. The transmission protocol converter is designed to connect platform call input/output units to the group control unit 110 via the platform transmission relay unit 114 and group control transmission lines 121 and 122 to convert one of transmission protocols into the other transmission protocol to control the registration and assignment of a platform call.

In such a group control system, even if the types of the platform control units $\mathbf{104}_1$ through $\mathbf{104}_n$ and $\mathbf{105}_1$ through $\mathbf{105}_n$ for the respective floors, which are connected to each other via a serial transmission part, are different or even if the transmission protocol is changed for maintenance, it is possible to surely correspond to the changed transmission protocol, and it is possible to improve the flexibility of platform apparatuses, so that it is possible to unify the platform apparatuses in the same system as well as between different systems.

However, in the above described conventional group controlled elevator control system, the transmission line for a platform call input/output, the transmission line for a lamp for informing of the arrival of an elevator and the assignment of a platform call, and the transmission line for the indication of the position of elevators must be wired in different systems, so that wiring works are large-scale and the term of works is long.

In addition, in order to change a plurality of one-car systems to a group control system during modification works, it is required to greatly change the systems, so that it costs a great deal and it takes a lot of time.

SUMMARY OF THE INVENTION

It is therefore an object of the present invention to eliminate the aforementioned problems and to provide a control system for group controlled elevators capable of easily forming a reliable group control system by connecting platform call input/output units and operation control units on each floor to each other by means of a transmission line of one system every one-car system and by connecting the operation control units to a group control system by means of another transmission line.

In order to accomplish the aforementioned and other objects, according to one aspect of the present invention, there is provided a group controlled elevator control system for controlling a plurality of elevators by assigning the optimum elevator to a registered platform call, said system comprising: a plurality of platform call input/output units, each of which controls the input/output of a platform call on each floor; a group control unit configured to assigning the optimum elevator to a platform call registered therein; a plurality of operation control units, each of which is provided in each of the elevators, configured to controlling the operation of a corresponding one of the elevators in response to at least an assignment control signal for said platform call; and a transmission line system configured to connecting said platform call input/output units, said operation control units and said group control system to each other, said transmission lime system connecting at least said platform call input/output units and operation control units each other by everyone of said elevators, and all of said operation control units being connected to said group control unit via said transmission line, so that said platform call input/output units are disconnected from said group control unit.

According to the above described group controlled elevator control system, since the platform call is transmitted to the group control unit via the transmission line for connecting the operation control unit to the platform call input/output unit, it is not required to provide a transmission line for connecting the group control system directly to the platform call input/output unit, so that it is possible to easily provide a group control system by combining a plurality of elevators of a one-car construction.

Preferably, said each of operation control units serves for group control means for transmitting signals each other and assigning the optimum elevator to a registered platform call, so that the distributed control system is constructed in place of the group control unit.

The group control system may comprise: means configured to deciding permission to register said platform call on the basis of predetermined information concerning such as non-stopping floor information; and a transmission unit configured to periodically transmitting a decided platform call registration permission signal to all of said operation control units, and each of said operation control units comprises: a transmission unit configured to receiving said platform call signal, which is inputted to said platform input unit provided on each floor, via said transmission line and for transmitting maid plat form input signal to other operation control units and said group control system by a simultaneous multiple address; and control means configured to lighting lamps of platform call buttons on the same floor.

Thus, if the platform call button provided on each floor is pushed, all of lamps of the platform call buttons on the same floor can be turned on, on the basis of information on non-stopping floors and building.

Each of the operation control units may comprise failure detecting means configured to monitoring the status of transmission between said group control unit and a corresponding one of said operation control units to detect a failure therein, wherein said failure detecting means responds directly to said platform call registered by said platform call input unit, with a response being suspended to said assignment control signal, when a failure is detected.

Thus, the status of transmission is monitored, and if the transmission fault occurs, it is possible to directly control the operation of the self-elevator without receiving any instructions from the group control system.

Each of the operation control units may comprise: arithmetic means configured to calculating a transmission time in which a data is transmitted from one of said operation control units to another control unit when said data is received and transmitted between said plurality of operation control units; and means configured to delaying the output of a lighting signal for said lamps of said platform call buttons by said transmission time which is calculated by said arithmetic means.

Thus, the lamps of the platform call buttons can be simultaneously turned on by delaying the lighting so as to compensate the platform call transmission lag.

Each of the operation control units may include means configured to outputting a door opening signal for controlling the opening of a door by a corresponding one of said operation control units without transmitting said platform call input signal to other operation control units and said group control system, when said platform call button connected to the corresponding one of said operation control units having responded to said platform call when said door which is open in response to at least said platform call intends to be closed.

Thus, when the door which has been open in response to the platform call is reopen in response to the platform call, the opening of the door is controlled without returning the platform call input for reopening to other operation control units and the group control system, so that the reaction of the reopening is rapid and the load of the transmission line can be reduced.

The group control elevator control system may further comprise a second transmission line for connecting the plurality of operation control units to each other in addition to a first transmission line for connecting the group control unit to the operation control units, wherein when the failure detecting means detects a failure, the group control unit stops receiving a platform call input signal from the first transmission line, and uses the platform call input signal transmitted from the second transmission line to carry out assignment.

Thus, even if the transmission fault occurs in the first transmission line, the platform call of the system having the transmission fault can be transmitted via the second transmission line to carry out the assignment control, so that it is possible to improve the reliability of the system.

At least adjacent two of the plurality of platform call input/output units on the same floor may be connected to each other as a pair via a back-up transmission line.

Thus, even if one system of the transmission lines for the platform call input/output units fails, it is possible to register the platform call via the transmission line of the other system.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of a control system for group controlled elevators according to the present invention will be described below.

(First Preferred Embodiment)

Figure 1:
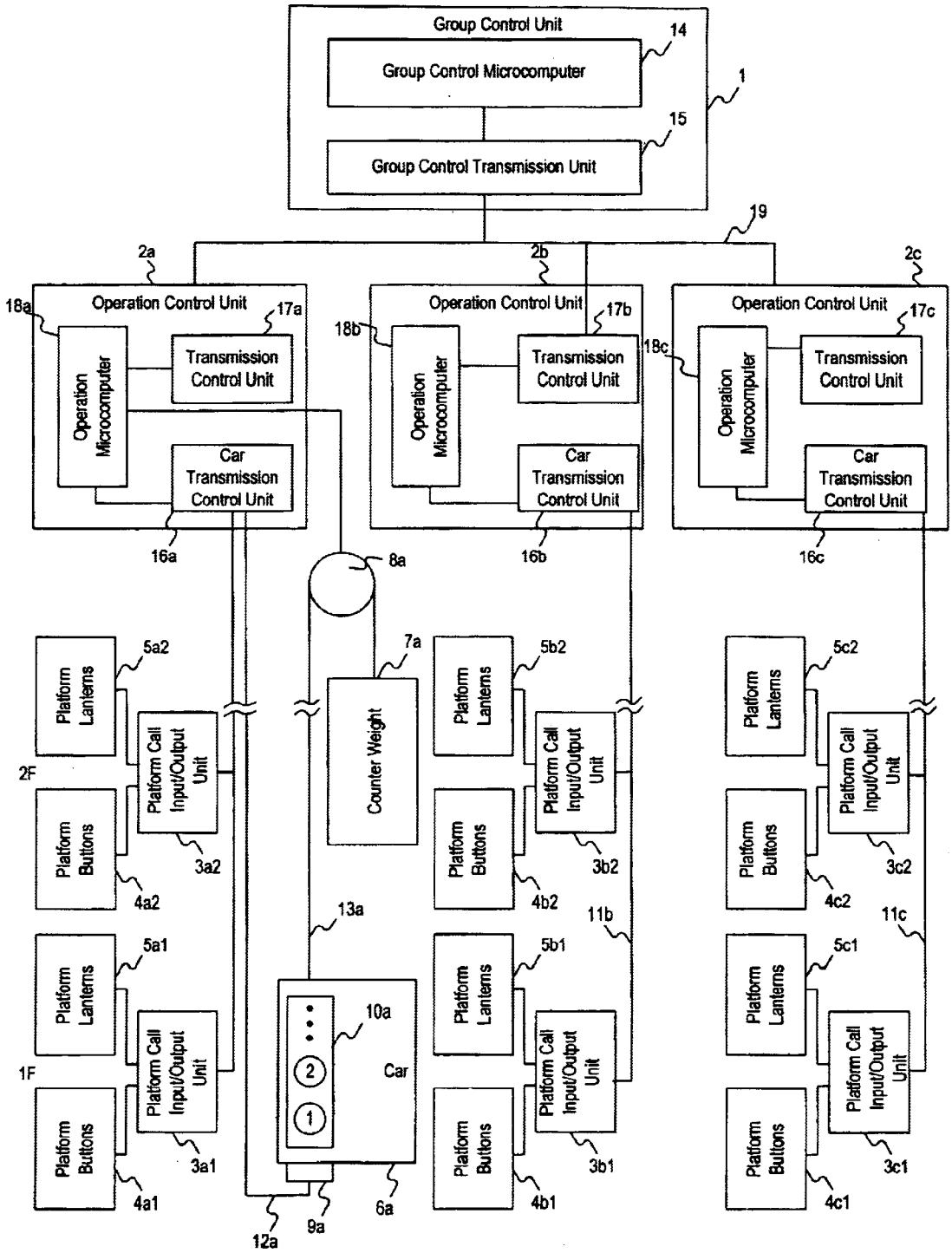
FIG. 1 is a system block diagram of the first preferred embodiment of a control system for group controlled elevators according to the present invention.

FIG. 1 is a block diagram showing the first preferred embodiment of a control system for group controlled elevators according to the present invention. This group control system is an example of a system where an operation service is carried out by three cars in a building having first through eighth floors. Reference number 1 denotes a group control system for carrying out an assignment control to a registered platform call. Reference numbers 2*a*, 2*b* and 2*c* denote operation control units for individually controlling the operation of elevators a, b and c, respectively.

For simple explanation, FIG. 1 shows only two floors of the first and second floors, and apparatuses, such as a hoist and a car, of only the elevator a. A car 6*a* is connected to a counter weight 7*a* via a main rope 13*a*, so that a hoistway moves upwards and downwards if a hoist 8*a* normally and inversely rotates, respectively.

The platform of each floor is provided with platform buttons 4*ai* through 4*ci* and platform lanterns 5*ai* through 5*ci* (i=1, 2, . . . , 8) as platform apparatuses for generating platform call signals. In FIG. 1, the platform buttons and platform lanterns for the elevators a, b and c are distinguished by adding subscripts a, b and c to 4 and 5, and the floors are also distinguished by adding the numbers of the floors as subscripts (the way of distinguishing apparatuses common to each floor and each elevator is hereinafter the same).

The group control unit 1 includes a group control microcomputer 14 for executing a group control processing, and a group controlling transmission control unit 15 having a signal transmitting/receiving function. The group control unit 1 is connected to operation control units 2*a* through 2*c* for elevators a, b and c via a group controlling transmission line 19.

The operation control units 2*a* through 2*c* comprise: operation control microcomputers 18*a* through 18*c*; group controlling transmission control units 17*a* through 17*c* for controlling the transmitting/receiving of signals to and from the group control unit 1; and car transmission control units 16*a* through 16*c* for controlling the transmitting/receiving of signals to and from the cars 6*a* through 6*c* and to and from a platform input/output unit, respectively.

The platform buttons 4*ai* through 4*ci* and the platform lanterns 5*ai* through 5*ci* are connected to each other for each elevator via the operation control units 2*a* through 2*c* and platform transmission lines 11*a* through 11*c* using platform call input/output units 3*ai* through 3*ci* for controlling the input/output of a platform call for each floor, as an interface.

As shown in FIG. 1, the car 6*a* has a car control panel 10*a* and a car input/output unit 9*a* for interfacing send and receive, and is connected to the operation control unit 2*a* via a car transmission line 12*a*. Other elevators b and c are the same, and not shown in FIG. 1.

Figure 2:
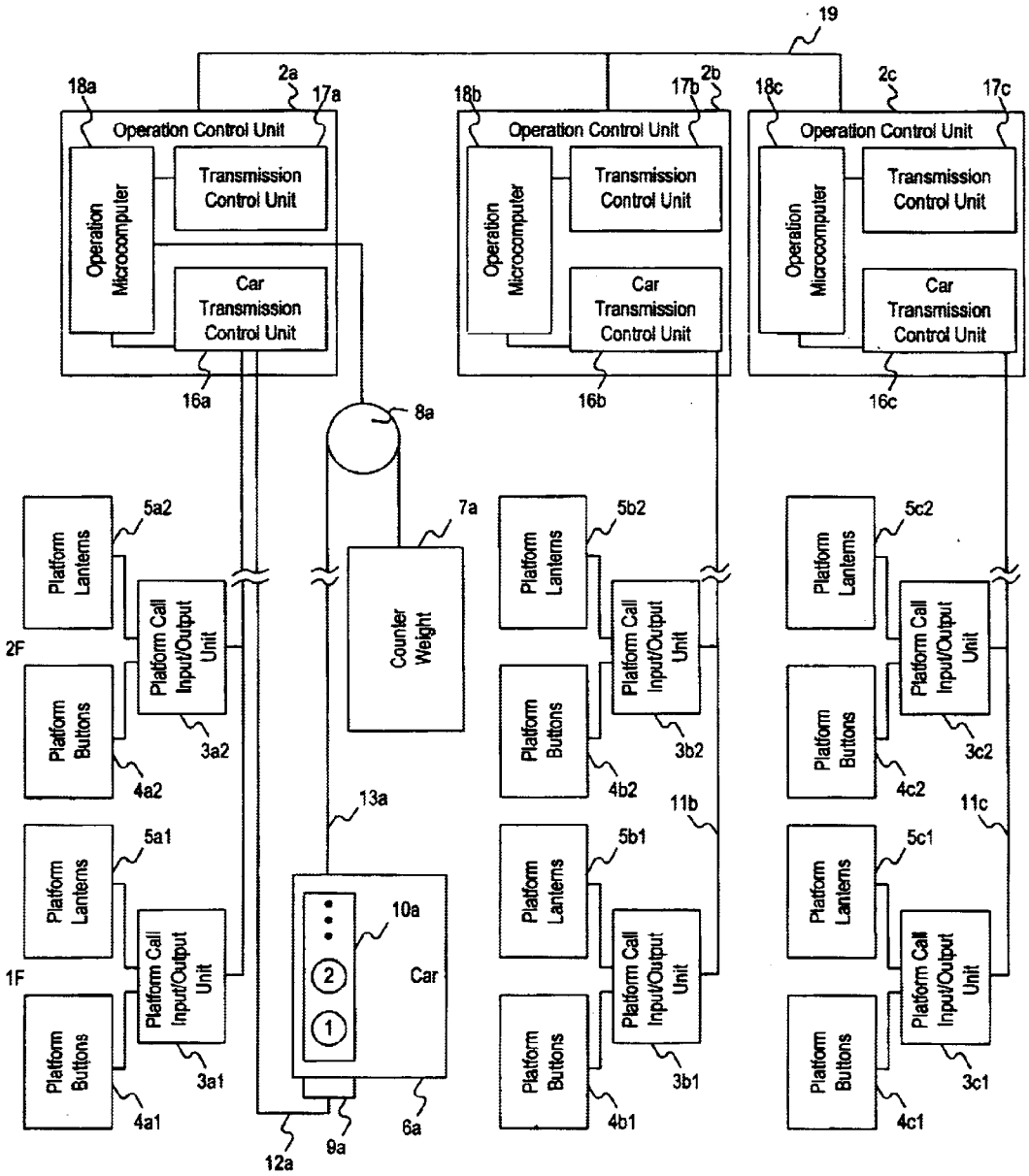
FIG. 2 is a system block diagram of the modified embodiment of a distributed control system for group controlled elevators in which each of operation control unit serving for the group control system according to the present invention.

FIG. 2 is a block diagram showing a modified embodiment of a control system for group controlled elevators according to the present invention. In this embodiment, the operation microcomputers 18*a*, 18*b* and 18*c* built in the operation control unit 2*a*, 2*b* and 2*c* are provided with functions for executing a group control processing without the group control Unit 1 shown in FIG. 1 to design a distributed group control system. The group controlling transmission control units 17*a* through 17*c* are capable of controlling the transmitting of signals between the operation control unit 2*a*, 2*b* and 2*c*. In FIG. 2, Except for not providing with the group control unit 1, the same numerical number shows the same component as the embodiment in FIG. 1. The detailed functions of the group control unit 1 are described below, which are common to the distributed group control system using the operation control unit 2*a*, 2*b* and 2*c*.

Figure 3:
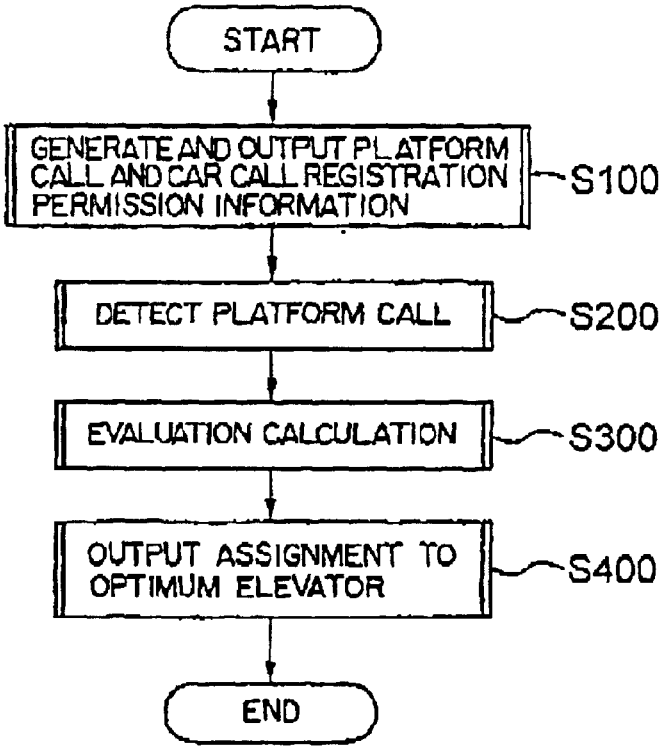
FIG. 3 is a flow chart showing a processing for a group control system.

FIG. 3 is a flow chart showing the contents of a processing in the group control unit 1. In FIG. 3, step S100 is a step of generating registration permission information which is referred for determining whether the input of a platform call or a car call is valid when the platform call or car call is inputted. The platform call and car call registration permission information is generated on the basis of information on non-stopping floors, which is inputted from a monitoring panel (not shown) or the like, and information on building construction, which has been stored in the internal storage of the group control microcomputer. The platform call and car call registration permission information is transmitted from the group control transmission unit 15 to the operation control units 2*a* through 2*c* of all of the elevators a through c via the group controlling transmission line 19. The contents of other steps (S200, S300 and S400) in the group control unit 1 are not different from those in conventional systems, and will be described as required.

Figure 4:
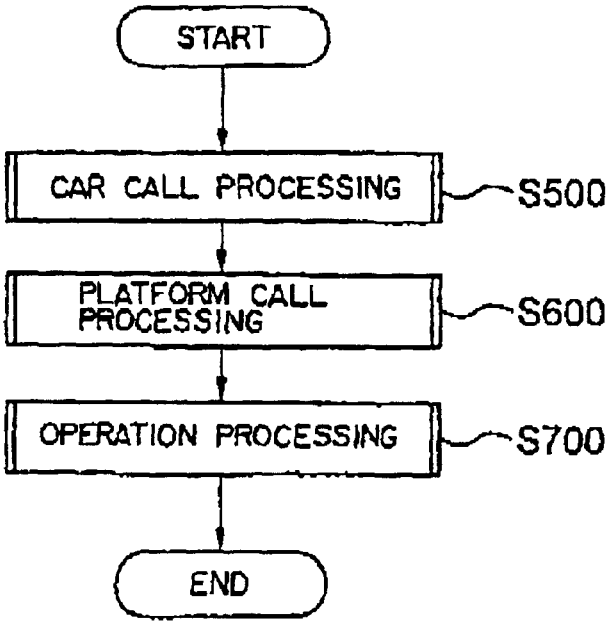
FIG. 4 is a flowchart showing a processing for an operation control unit.

FIG. 4 is a flow chart showing the contents of the processing in each of the operation control units 2*a* through 2*c*. As an example of the flow of a series of processes of the registration, assignment and response of a platform call, the flow when the platform call button 4*al* of the platform call buttons 4*al* through 4*cl* on the first floor is pushed will be described below.

As shown in FIG. 4, the processing function of the operation control units 2*a* through 2*c* is generally divided into a car call processing (step S500), a platform call processing (step S600) and an operation processing (step S700).

1. Platform Call Processing

First, if a passenger pushes the platform call button 4*al*, a platform call input signal indicative of the platform call is inputted to the platform input/output unit 3*al* to be transmitted to the car transmission unit 16*a* of the operation control unit 2*a* of the elevator a via the platform transmission line 11*a* by the scan transmission system. This scan transmission system will be described later. If the car transmission unit 16*a* receives the platform call input signal, the car transmission unit 16*a* transmits this signal to the operation control microcomputer 18*a*.

The operation control microcomputer 18*a* determines whether the platform call input is valid on the basis of platform call registration permission information which is transmitted from the group control unit 1. If the platform call input is valid, the operation control microcomputer 18*a* transmits a platform call lump lighting signal from the car transmission unit 16*a* to the platform input/output unit 3*al* via the platform transmission line 11*a*. Thus, the platform call input is registered, and the lamp of the platform call button 4*al* on the first floor is turned on.

Simultaneously with the registration of the platform call input and the lighting of the platform button 4*al*, the operation control unit 2*a* transmits a platform call input signal from the group controlling transmission unit 17*a* to the group control unit 1 and the operation control units 2*b* and 2*c* of the elevators b and c via the group controlling transmission line 19. Similarly, the operation control microcomputers 18*b* and 18*c* having received the platform call input transmit a platform call button lamp lighting signal from the car transmission units 16*b* and 16*c* to the platform input units 3*b*1 and 3*c*1 via the platform transmission lines 11*b* and 11*c*, respectively. Thus, the lamps of the platform call buttons 4*b*1 and 4*c*1 are turned on, and the lamps of all of the platform call buttons 4*a*1, 4*b*1 and 4*c*1 on the first floor are turned on.

On the other hand, as shown in the flow chart of FIG. 3, the group control microcomputer 14 assigns the optimum elevator in response to the platform call as follows.

That is, when the group control microcomputer 14, to which the platform call input has been transmitted from the operation control unit 2*a*, detects the platform call input via the group controlling transmission unit 15 (step S200), the group control microcomputer 14 carries out an evaluation calculation on the basis of the state of each elevator (step S300). Then, the group control microcomputer 14 selects an elevator (e.g., elevator c), which has the best evaluated value, as the optimum elevator, and transmits an assignment signal indicative of the assignment of the optimum elevator from the group control transmission unit 15 to the operation control unit 2*c* of the elevator c via the group controlling transmission line 19 (step S400).

2. Operation Processing

The operation control microcomputer 18*c*, which has received the assignment signal for the registered platform call, causes the platform lantern (forecasting lamp) on the first floor, which is the registered floor, to be turned on to inform of the assignment, and carries out an operation processing for causing the elevator c to respond thereto (step S700). If the elevator c approaches the first floor to start to deceleration, the operation control microcomputer 18*c* causes the platform lantern (arrival lamp) on the first floor to be turned on to inform of the arrival, and generates a platform call button lamp turning-off signal. The lamp turning-off signal is transmitted to the platform input/output unit 3*c*1 via the platform transmission line 11*c* in the elevator c, and transmitted to the platform input/output units 3*a*1 and 3*b*1 via the operation control units 2*a* and 2*b* in the elevators a and b, respectively. Thus, on the first floor, the lamps of the platform call buttons 4*a*1, 4*b*1 and 4*c*1 are turned off simultaneously with the arrival of the car of the elevator c.

3. Car Call Processing

Thus, after the elevator c is open on the first floor, when a passenger gets into the car 6*c* and pushes a car-call button for a destination floor of the car control panel 10*c* in the car, a car call processing is executed as follows.

A car call input signal is transmitted from the car input/output unit 2*c* to the operation control microcomputer 18*c* of the operation control unit 2*c* of the elevator c via the car transmission line 12*a* and the car transmission unit 16*c*. The operation control microcomputer 18*c* refers to car call registration permission information, which is transmitted from the group control unit 1 to the group controlling transmission line 19, to determine whether the car call input is valid. If it is valid, a car call lamp lighting signal is transmitted from the car transmission unit 16*c* to the car input/output unit 9*c* via the car transmission line 12*c*. Thus, in the car 6*c* of the elevator c, the car call lamp for the destination floor of the car control panel 10*c* is turned on, and the car call input is registered. Simultaneously, the operation control unit 2*c* causes the registered car call to respond thereto, and causes the car 6*c* to move toward the destination floor. When the car 6*c* arrives at the car call registered floor and the door is open, the operation control unit 2*c* transmits a car call lamp turning-off signal via the car transmission line 12*c* to cause the car call button lamp of the car input/output unit 9*c* to be turned off.

While the flow of the series of processes for the registration, assignment and response of the platform call has been described above, the details of the processes will be described below.

4. Details Of Platform Call Processing

Figure 5:
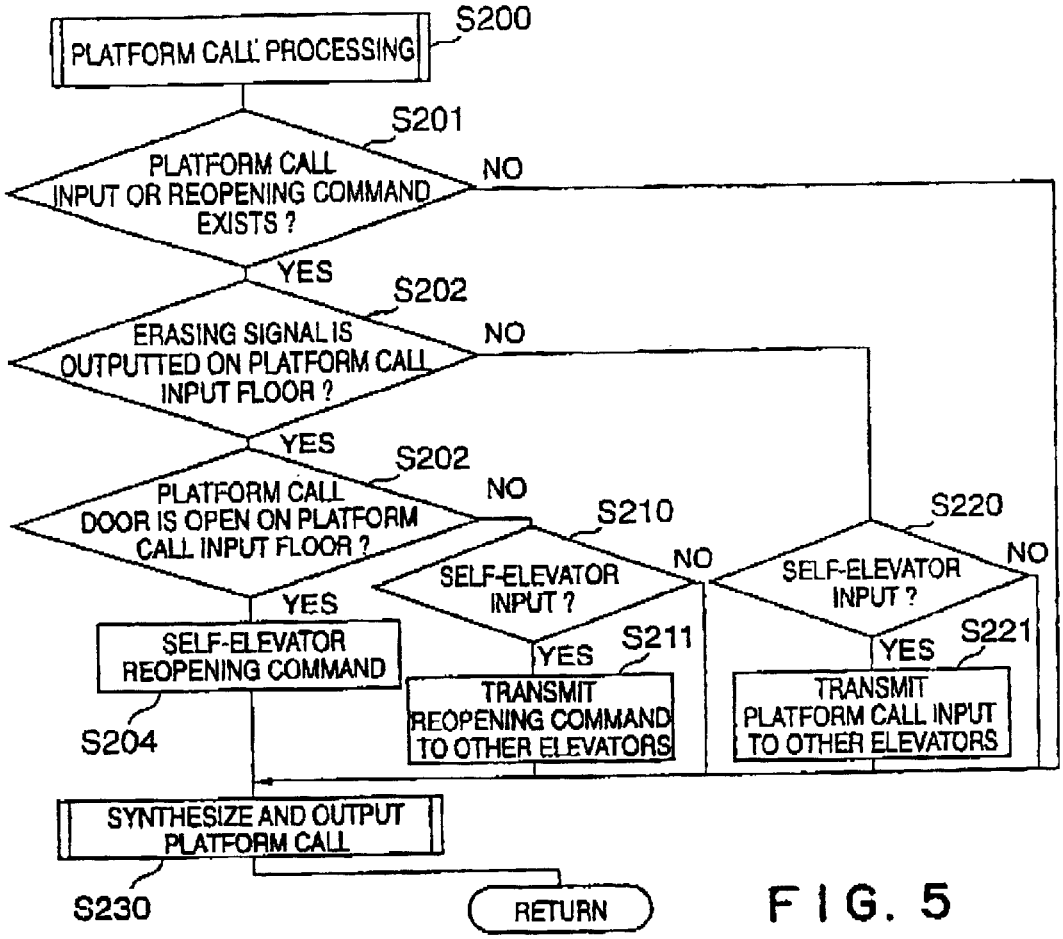
FIG. 5 is a flow chart showing the details of a platform call processing.
Figure 7:
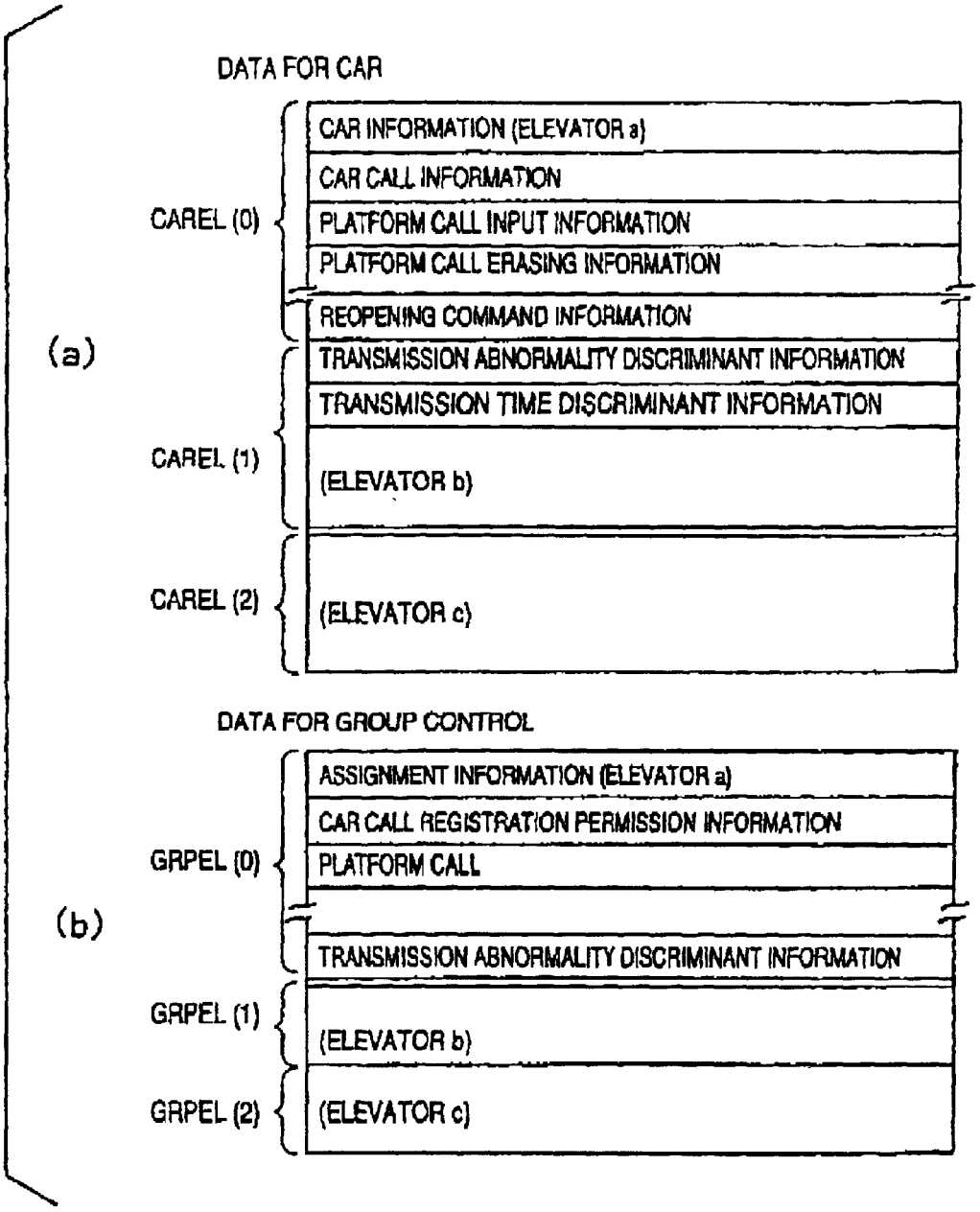
FIG. 7 is an illustration showing a data configuration for car data and group control data.

FIG. 5 is a flow chart showing the details of the contents of the platform call processing (step S200). FIG. 7(*a*) is a block diagram of a car data which has been stored in the internal storage of each of the operation control units 2*a* through 2*c*. In FIG. 7(*a*), for example, a car data for the elevator a is assigned to CAREL (0), a car data for the elevator b is assigned to CAREL (1), and a car data for the elevator c is assigned to CAREL (2). The contents of these car data are updated by periodically repeating send and receive between the operation control units 2*a* through 2*c* of the elevators a through c. For example, the operation control unit 2*a* of the elevator a transmits the data of CAREL (0) to the operation control unit 2*b* of the elevator b and the operation control unit 2*c* of the elevator c, and receives the data of CAREL (1) from the operation control unit 2*b* and the data of CAREL (2) from the operation control unit 2*c*.

First, the operation control microcomputers 18*a* through 18*c* of the operation control units 2*a* through 2*c* of the respective elevators check whether there is a platform call input or a reopening command in the self-elevator or other elevators (step S201). As an example, a case where the platform call button 4*a*1 of the elevator a on the first floor is pushed will be described below, The operation control unit 2*a* of the elevator a refers to platform call input information and platform call erasing information for CAREL (0) to determine whether a platform call erasing signal has been generated on the floor for which the platform call has been inputted (the first floor in this example) (step S202). If no platform call erasing signal has been generated on this floor (no at step S202), the platform call input is a platform call input in the self-elevator (step S220), and the platform call input is transmitted to the operation control units 2*b* and 2*c* of the elevator b and c.

If the platform call erasing signal is generated on the first floor (yes at step S202), it can not be determined whether the platform call button 4*al* has been pushed to open the door of the elevator a again or to open the doors of the elevators b and c again, so that the routine goes to step S203. If the door of the elevator a is open on the first floor (yes at step S203), it is determined that reopening is requested of the self-elevator, so that a reopening command is transmitted (step S204).

On the other hand, if the door of the elevator a is open on the first floor and if the platform call input is a platform call input from the self-elevator, it is determined that reopening is requested of another elevator, so that a reopening signal is transmitted to the operation control units 2*b* and 2*c*.

Figure 8:
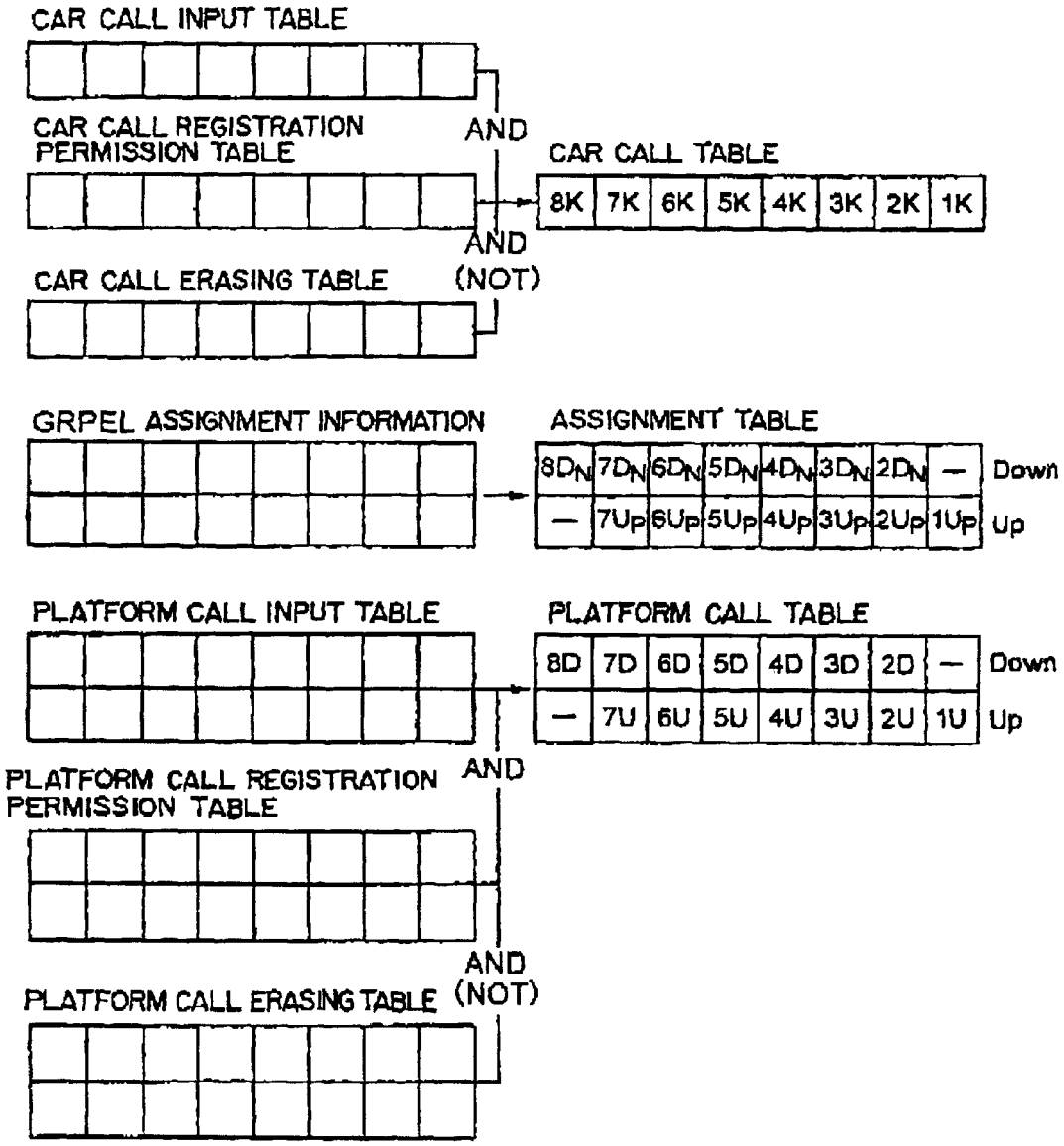
FIG. 8 is an illustration showing an example of a car call table, a platform call table and an assignment table.

At the final step S230, data of the platform call input table, platform call registration permission table and platform call erasing table shown in FIG. 8 are synthesized to output the results thereof as a platform call lamp lighting signal (step S230).

This will be described below in detail. In the platform call input table, if a platform call input exists, a bit on the corresponding floor is set to be 1. Similarly, if a platform call registration permission exists, a bit on the corresponding floor of the platform call registration permission table is set to be 1, and if a platform call erasing signal is generated, a bit on the corresponding floor is set to be 1. If non-stopping floors are set in platform call registration permission information, a bit on the corresponding floor of the platform call registration permission table is 0.

These data tables are synthesized by logically operating the logical product AND of the platform call input, the platform call registration permission and the inversion of the platform call erase. Therefore, if the platform call erasing signal is generated, the platform call input on the corresponding floor is erased by the synthesis, and if the non-stopping floor is set, it is impossible to carry out a platform registration after the platform call input on the corresponding floor is similarly erased.

Also, in the car call processing, data of a car call input table, car call registration permission table and car call table shown in FIG. 8 are similarly synthesized by a logical operation to produce a car call table to output a car call button lamp lighting signal on the basis thereof. Although the format of the data table is different, the contents of the processing is the same.

5. Operation Processing With Transmission Monitoring Function

The contents of the operation processing will be described below in more detail.

Figure 6:
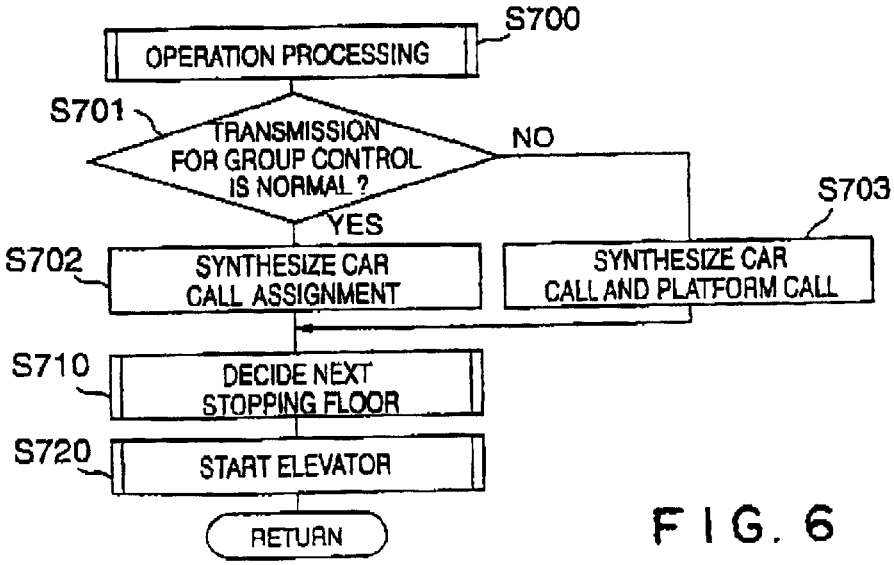
FIG. 6 is a flow chart showing the details of an operation processing.

FIG. 6 is a flow chart showing the contents of the operation processing. In this operation processing, it is first checked whether the data transmission between the operation control units 2*a* through 2*c* of the elevator a through c and the group control unit 1 normally functions (step S701). As an example of this, the checking of the data transmission between the operation control unit 2*a* of the elevator a and the group control unit 1 will be described below.

First, the operation control unit 2*a* sets 1 in transmission abnormality discriminant information of CAREL (0) of car data shown in FIG. 7(*a*), and transmits this transmission abnormality discriminate information to the group control unit 1. If the group control unit 1 receives the transmission abnormality discriminate information, the group control unit 1 increments the set value 1 to add 1 thereto, and sets the incremented value in transmission abnormality discriminate information of GRPEL (0) of group controlling data shown in FIG. 7(*b*) to transmit this transmission abnormality discriminate information to the operation control unit 2*a*. Such send and receive of the transmission abnormality discriminate information are periodically repeated. If a normal value is not returned to the operation control unit 2*a* and the group control unit 1 even if a predetermined period of time elapses, it is determined that the transmission between the operation control unit 2*a* and the group control unit 1 is abnormal.

After such a transmission status checking, if the transmission is normal, each of the operation control units 2*a* through 2*c* synthesizes a car call table and a platform call table by the above described logical operation referring to FIG. 8, and produces an assignment table, which is shown in FIG. 8, on the basis of assignment information transmitted from the group control unit 1 (step S702). Then, the next stopping floor is determined in view of the current position and direction of the car of the elevator (step S710), and starts the elevator to cause the elevator to respond to the next stopping floor (step S720).

On the other hand, if abnormality is detected in the data transmission, the assignment information transmitted from the group control unit 1 is not used, and therefore, the assignment table is not produced. Then, the car call table and the platform call table are synthesized (step S703) Thereafter, the next stopping floor is determined on the basis of these tables (step S710), and the elevator is started (step S720). For example, if 3K in the car call table is set to be 1, if 5Up in the assignment table is set to be 1 and if the direction of the car at the current position of the car is UP direction on the first floor, the next stopping floor corresponds to the car call on the third floor, and then, the elevator responds to the platform call on the fifth floor.

6. Scan Transmission System For Platform Call

Referring to the transmission conceptual diagram of FIG. 9, the transmission map of FIG. 10, the data block diagram of FIG. 11 and the flow chart of the transmission processing of FIG. 12, the scan transmission method for a platform call input will be described below.

Figure 9:
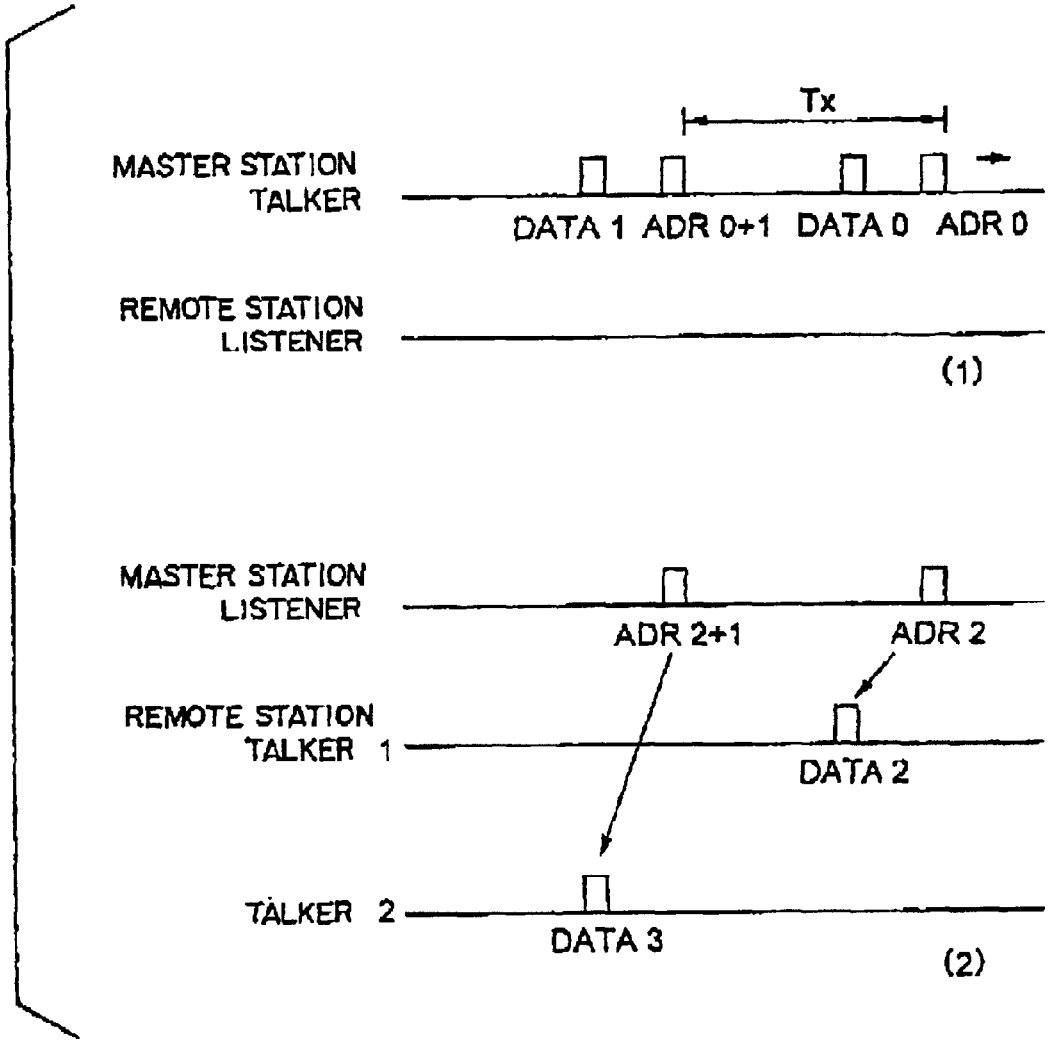
FIG. 9 is a conceptual diagram of a scan transmission system for a platform call input.
Figure 10:
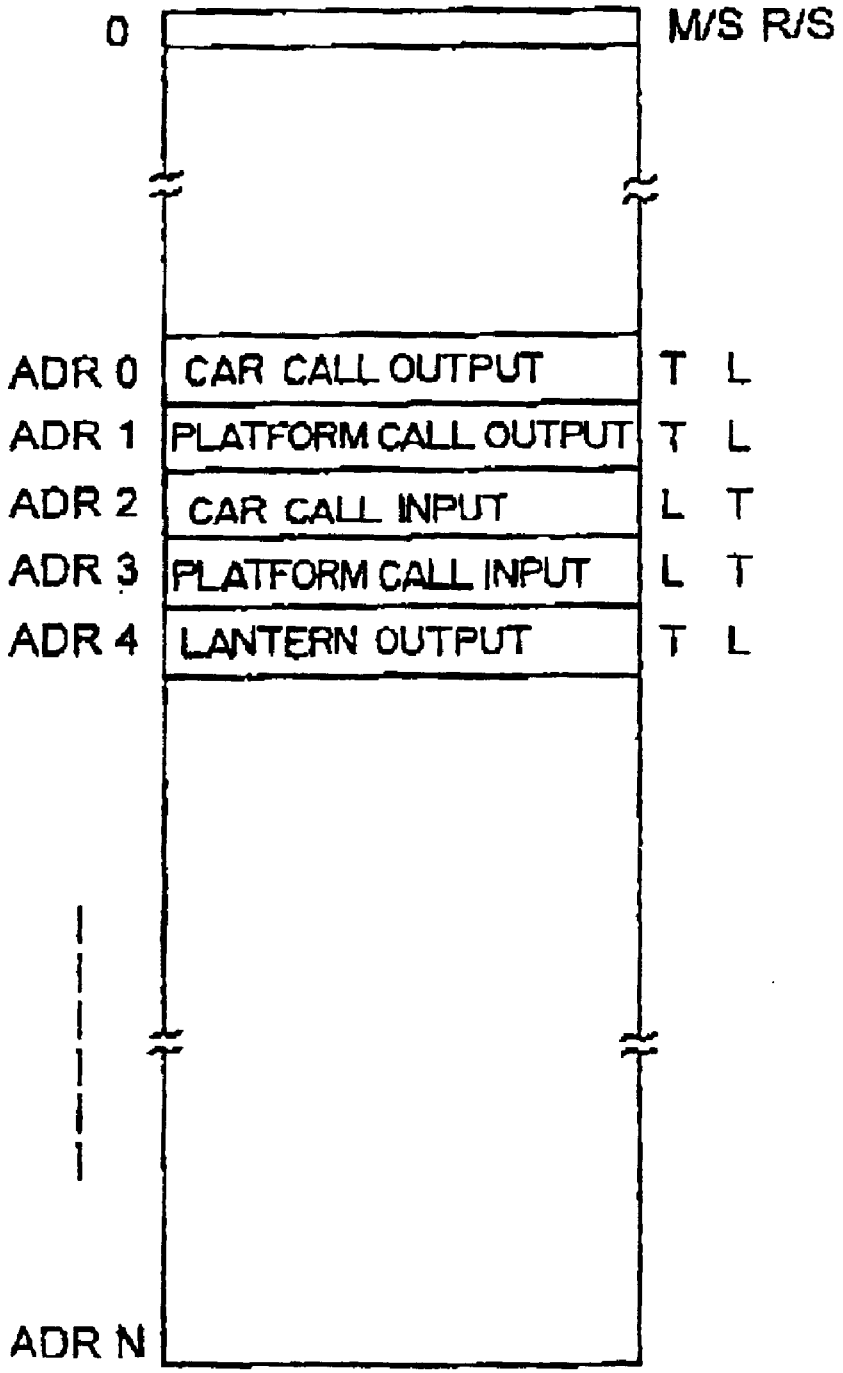
FIG. 10 is a transmission map in a platform call input scan transmission.

In FIG. 9, in the respective elevators a through c, the car transmission units 16*a* through 16*c* with the operation control units 2*a* through 2*c* are master stations, and the platform call input/output units 4*ai* through 4*ci* (i=1, 2, . . . , 8) connected to the respective master stations via the platform transmission lines 11*a* through 11*c*, respectively, are remote stations, respectively.

For example, the elevator a will be described below. As shown in FIG. 10, a mapping is carried out so that, in data regions 0 through ADRN, a car call output area having ADR0 as a head address is assigned to the talkers of the master stations (abbreviated to T in FIG. 10) and the listeners of the remote stations (abbreviated to R in FIG. 10), and in the subsequent addresses, a platform call output area having ADR1 as a head address is assigned to the talkers of the master stations and the listeners of the remote stations, a car call input area having ADR2 as a head address is assigned to the talkers of the master stations and the listeners of the remote stations, a platform call input area having ADR3 as a head address is assigned to the talkers of the master stations and the listeners of the remote stations, and a lantern output area having ADR4 as ahead address is assigned to the talkers of the master stations and the listeners of the remove stations.

Figure 11:
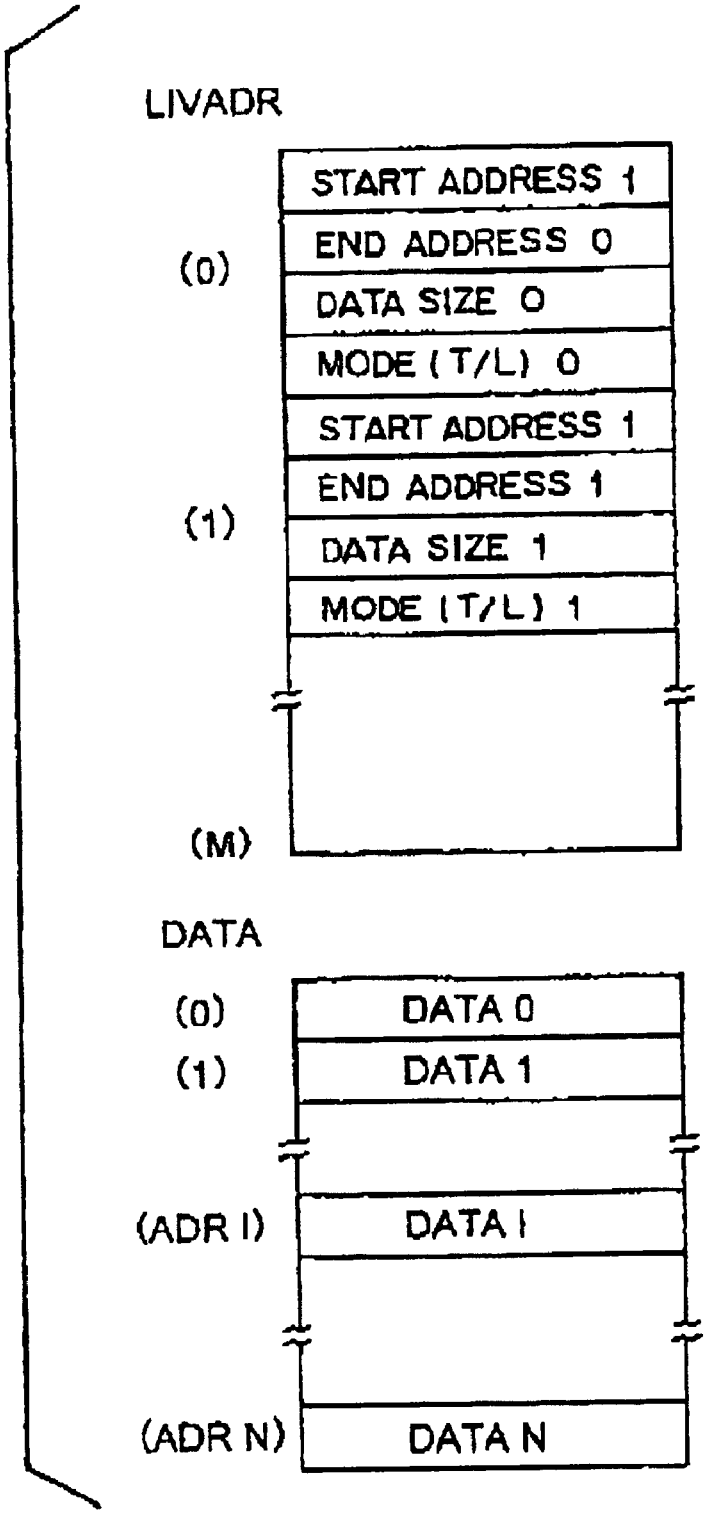
FIG. 11 is a schematic diagram showing a transmission data table in a platform call input scan transmission.

This map information is stored in a data table, which comprises areas LIVADR (0) through LIVADR (M) as shown in FIG. 11, every area using a start address, an end address, a data size and a transmission mode (talker or listener) as one set.

Referring to the flow chart of FIG. 12, the processing for the master station will be described below. First, the master station reads an LIVADR table (step S801), and transmits an address X to indexes 0 through N of the LIVADR table (step S802) on the basis of a data length transmission mode (step S804).

If the master station is a talker, a data DATA (X) corresponding to the address of a DATA table shown in FIG. 11 is outputted (step S806). If the master station is a listener, a timer is started (step S807), and it waits for a period of time Tx until data is received (steps S808 and S809).

Figure 12:
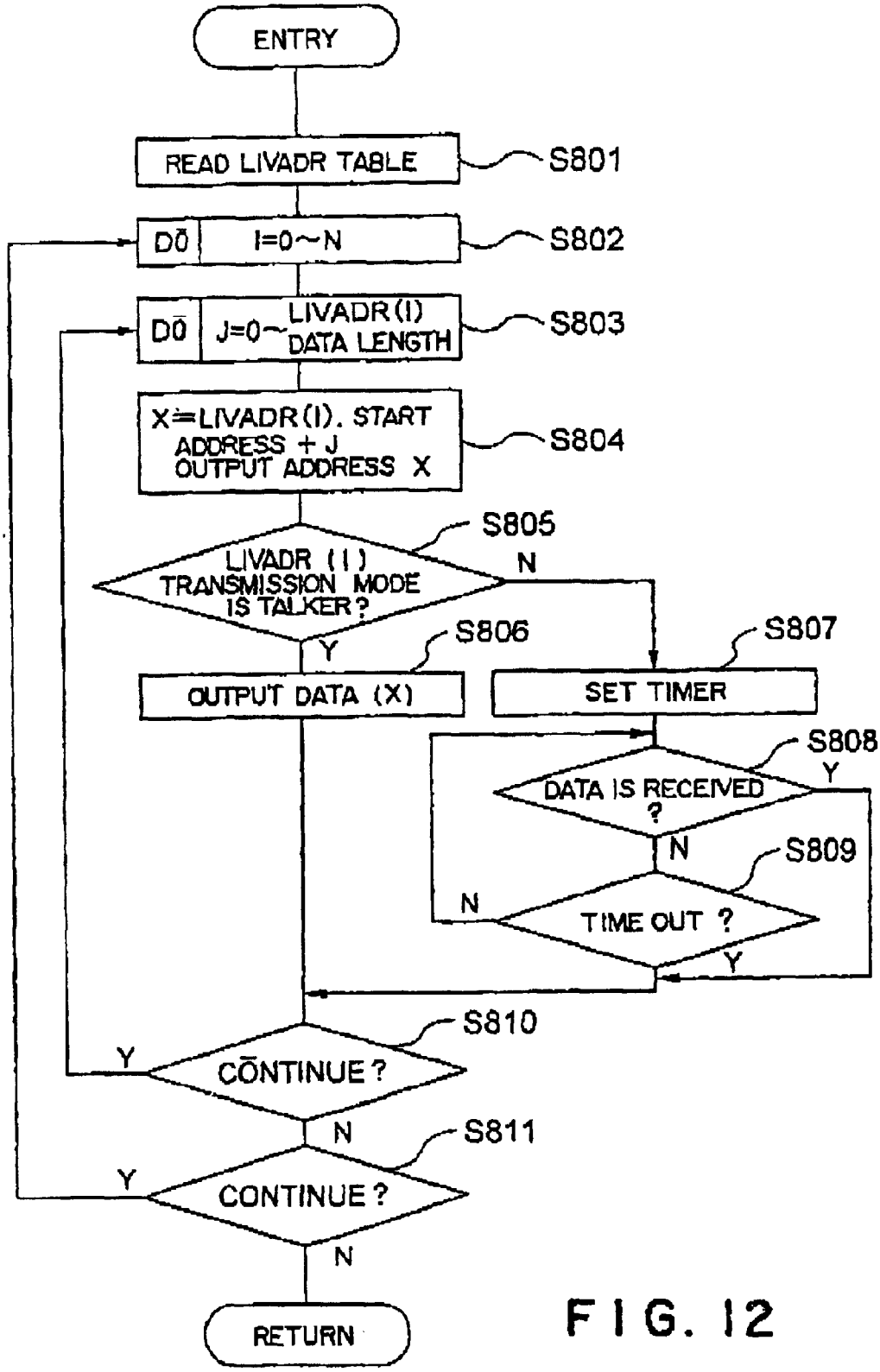
FIG. 12 is a flow chart showing the details of a transmission processing.

On the other hand, the processing for the master station is the same as the flow of the processing of FIG. 12, except that the address transmission processing in the master station is replaced with an address receiving processing. That is, if an address of the talker area is received, DATA corresponding to the address is returned to the master station, and if an address of the listener area is received, DATA is subsequently received.

FIG. 9 shows the relationship between addresses on the transmission line and data when the master station and the remote station are classified into talkers and listeners. If the master station is a talker, ADR0 and DATA0 are continuously transmitted, and an address ADR+1 next to ADR0, together with DATA1, is continuously transmitted within a period of time Tx. On the other hand, since the remote station is a listener, nothing is returned from the remote station.

On the other hand, if the master station is a listener, when ADR2 is returned, the remote station 1 receives ADR2 and returns DATA2. When the master station receives DATA2 within a period of time Tx, the master station returns an address ADR2+1 next to ADR, and the remote station 2 receives ADR2+1 and returns DATA3. Thus, the platform call input/output units 3*ai* on the respective floors and the car transmission units 16*a* of the operation control unit 2*a* transmit data by the scan transmission system.

7. Platform Call Button Lighting Timing Function

In the group control system according to the present invention, the platform transmission lines 11*a* through 11*c* are individually provided in each of the elevators a through c, so that the platform call button lamp lighting signal on the same floor is transmitted via the group control transmission. If the group control transmission line 19 is a high speed transmission line, the lighting timing on the same floor is substantially the same time.

However, if the group control transmission is a low speed transmission line, there is some possibility that the lighting timing on the same floor may be shifted.

Therefore, the group control system measures a transmission lag time on the basis of data of transmission time discriminate information, and delays the timing in transmitting a lamp lighting signal by the transmission lag time, so that the function of simultaneously lighting lamps on the same floor can be added to the platform call processing of FIG. 5. Referring to the conceptual diagram of FIG. 13, the measurement of the transmission lag time will be described below.

Figure 13:
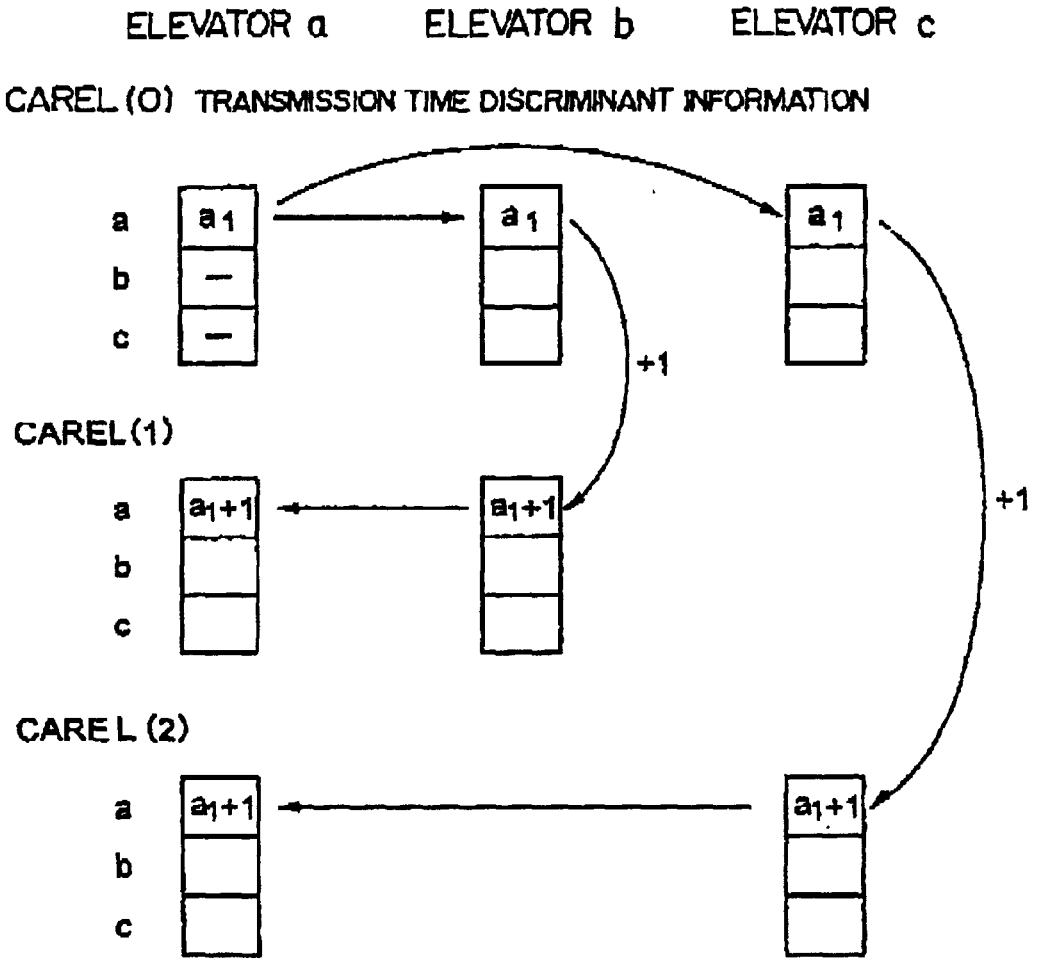
FIG. 13 is a conceptual diagram showing a transmission lag time measurement.

FIG. 13 conceptually shows the transmission lag between the elevators a and b, and the transmission lag between the elevators a and c.

The car data shown in FIG. 8 includes data of transmission time discriminate information every elevator.

For example, after the operation control unit 2*a* for the elevator a sets a1 in the transmission time discriminate information data in the car data table CAREL (0), the operation control unit 2*a* starts the timer, and transmits CAREL (0) to the operation control units 2*b* and 2*c* of the elevators b and c. Immediately after the operation control units 2*b* and 2*c* for the elevators b and c receive CAREL (0), the operation control units 2*b* and 2*c* refer to the set transmission time discriminate information, data a1 of the elevator a, and sets a1+1, which is obtained by adding 1 to a1, in the transmission time discriminate information data of CAREL (1) for the elevator b, and a1+1, which is similarly obtained by adding 1 to a1, in the transmission time discriminate information data of CAREL (2) for the elevator c, to return the set data to the elevator a.

Then, immediately after the operation control unit 2*a* for the elevator a receives CAREL (1) and CAREL (2), the operation control unit 2*a* stops the timer, and refers to the transmission time discriminate information data a of CAREL (1) and CAREL (2). If the transmission time discriminate information data is a1+1, the operation control unit 2*a* regards as normal between transmissions and sets half the time measured by the timer as the transmission lag time. This transmission lag time is a period of time for which the timing in outputting the platform call button lighting signal is delayed as a result of synthesis of the platform call at step S230 in FIG. 5. If the timing is thus delayed, even if the group controlling transmission line 19 is a low speed transmission line, it is possible to simultaneously the platform call button lamps without dispersing the lighting timing.

8. Group Controlled Elevator Control System Of Multiple System

Figure 14:
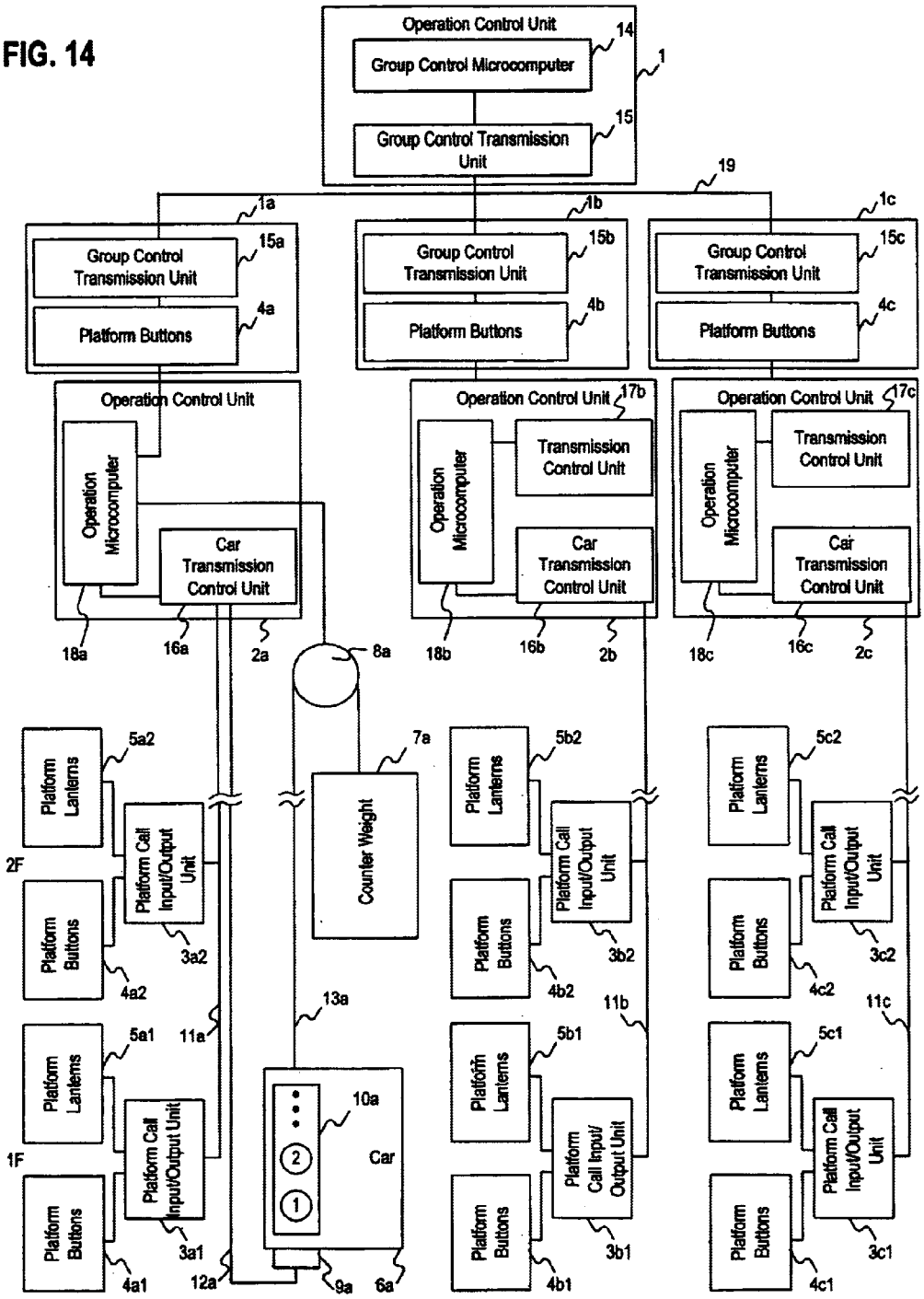
FIG. 14 is a system block diagram of a group controlled elevator control system of a multiple system.

While the group controlled elevator control system in the above described preferred embodiment has been comprised one group control unit 1, the system block diagram of FIG. 14 shows an example where a group control system of a multiple system having higher reliability is constructed by adding group control systems 1*a* through 1*c* for the respective elevators a through c to a main group control unit 1.

(Second Preferred Embodiment)

Figure 15:
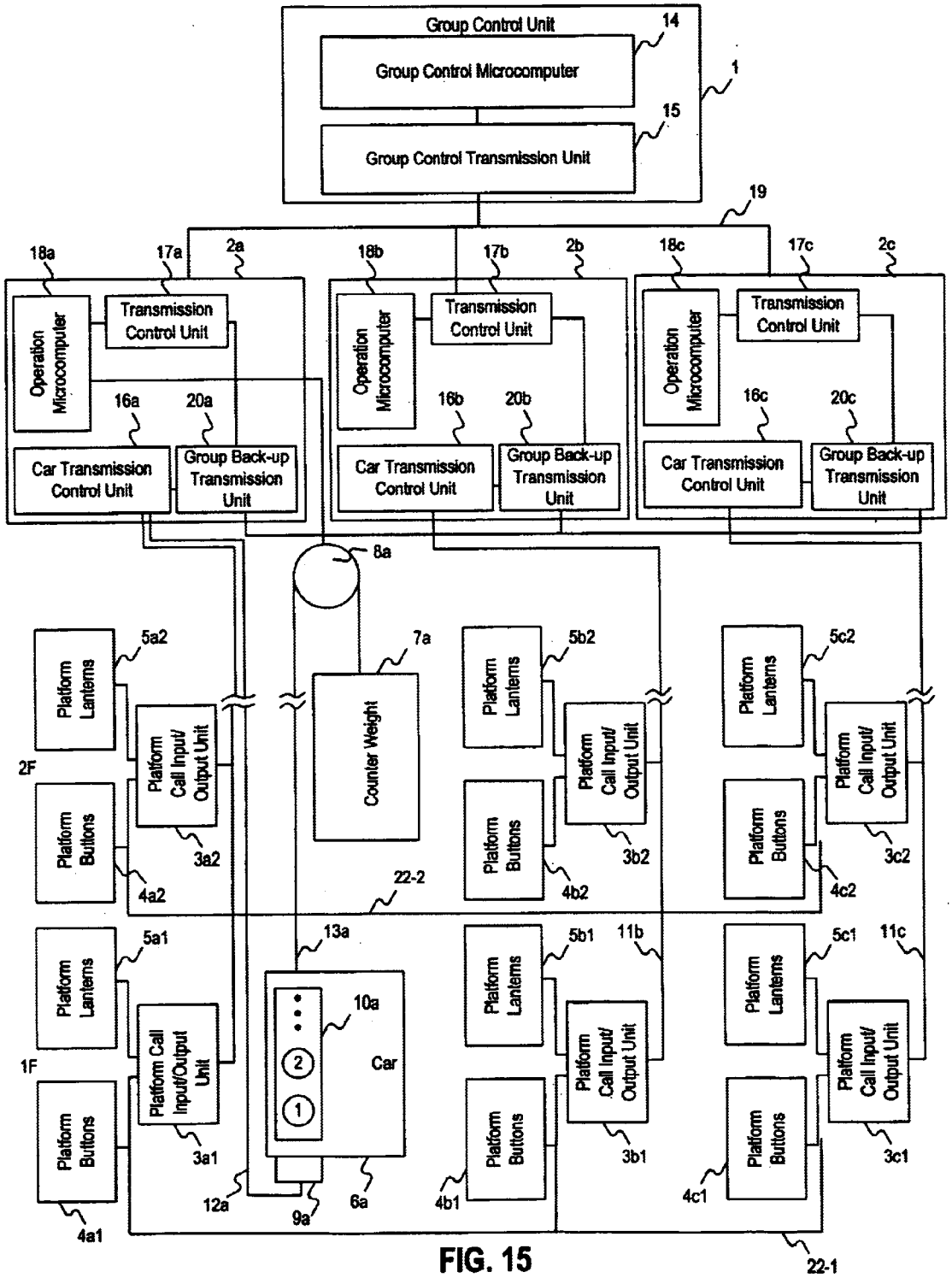
FIG. 15 is a system block diagram of the second preferred embodiment of a control system for group controlled elevators according to the present invention.
Figure 16:
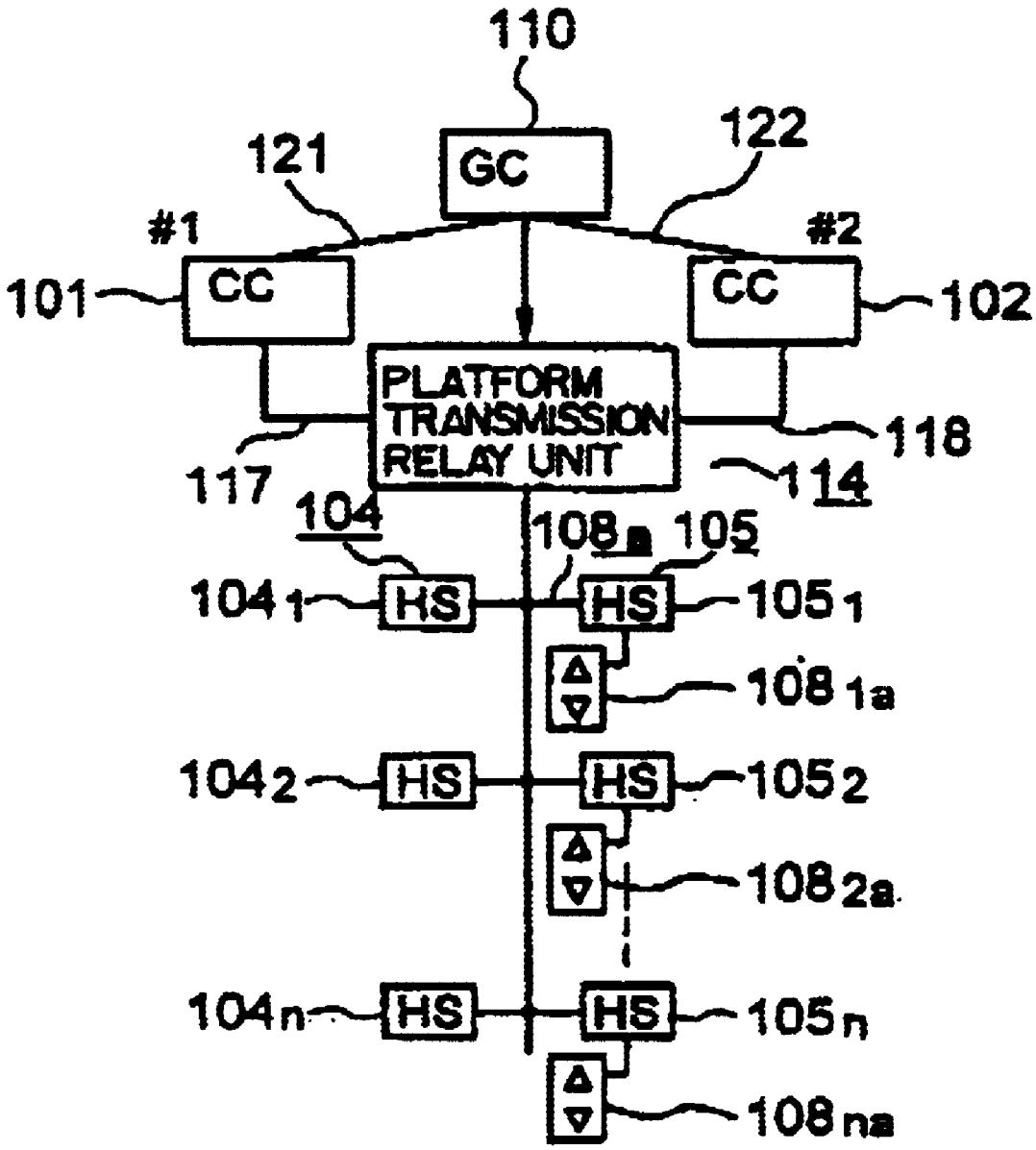
Prior Art FIG. 16
FIG. 16 is a system block diagram of a conventional control system for group controlled elevators.

FIG. 15 is a block diagram of the second preferred embodiment of a group controlled elevator control system according to the present invention.

The difference between the group controlled elevator control system in the second preferred embodiment shown in FIG. 15 and the system of FIG. 1 is that the following back-up signal line is provided.

First, the platform buttons provided on each floor are connected so that an OR circuit is electrically formed by a back-up signal line on the same floor. In FIG. 15, the platform buttons 4*a*1 through 4*c*1 on the first floor are connected by a back-up signal line 22-1, and the platform buttons 4*a*2 through 4*c*2 on the second floor are connected by a back-up signal line 22-2. Other floors are the same although it is not shown.

If the platform buttons are thus connected by the back-up signal line, when the platform button 4*a*1 on the side of the elevator a is pushed on the first floor, the call input is inputted to all of the platform input/output units 3*a*1 through 3*c*1 on the first floor via the back-up signal line 22-1, so that the platform call due to the platform call button 4*al* is surely registered even if the platform input/output unit 3*al* or the platform transmission line 11*a* fails.

Secondary, the respective operation control units 2*a* through 2*c* for the elevators a through c are provided with group back-up transmission units 20*a* through 20*c* in addition to the car transmission units 16*a* through 16*c* and the group controlling transmission units 17*a* through 17*c*. These group back-up transmission units are connected in parallel via a group back-up transmission line 21. Similar to the car transmission units 16*a* through 16*c*, the group back-up transmission units 20*a* through 20*c* carry out transmission by the scan transmission, and have areas for platform call input and output, the number of which corresponds to the number of the elevators, in the memory map shown in at least FIG. 10. The elevator a carries out transmission as a master station, and the elevators b and c carry out transmission as remote stations.

If the transmission between the group control unit 1 and each of the operation control units 2*a* through 2*c* is abnormal, platform call information is transmitted from the car transmission units 16*a* through 16*c* to any one of the back-up transmission unit 20*a* through 20*c* for another normal elevator via the group control back-up transmission line 21. The back-up transmission unit having received the platform call information transfers it from the group controlling transmission unit of the self-elevator to the group control unit 1 via the group control transmission line 19. Therefore, the group control system can carry out an evaluation calculation on the basis of platform call information, which is transmitted via a back-up transmission system, except for an abnormal elevator, to output a command to the optimum elevator, so that it is possible to enhance the reliability of the group control system.

As can be clearly seen from the foregoing, according to the present invention, the platform call input/output unit for each floor is connected to the operation control unit every one-car system by means of the transmission line of one system, and each of the operation control units is connected to the group control system by means of another transmission line. Therefore, the group control system can be easily formed, and the reliability thereof can be enhanced.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A group controlled elevator control system for controlling a plurality of elevators by assigning the optimum elevator to a registered platform call, said system comprising:

a plurality of elevators, wherein each elevator is capable of operating independently as a one-car elevator system;

a plurality of platform call input/output units, wherein each platform call input/output unit controls the input/out of the registered platform call on each floor;

a group control unit configured to assign the optimum elevator to a platform call registered therein;

a plurality of operation control units, wherein each operation control unit is provided in each of a one-car elevator systems, and configured to control the operation of a corresponding elevator in response to at least an assignment control signal for a registered platform call; and a transmission line system comprising a first transmission line for independently connecting said platform call input/output unit to said operation control unit at every said one-car elevator system and a second transmission line for connecting said group control unit to each of said operation control units at every said one-car elevator system and connecting said operation control units to each other.

2. A group controlled elevator control system as set forth in claim 1, wherein said group controlled elevator control system is provided with a distributed control system instead of the group control unit so that the operation control units transmit signals between each other and assign the optimum elevator to a registered platform call.

3. A group controlled elevator control system as set forth in claim 1 or 2, wherein said group control unit comprises:

means configured to decide to register said platform call based on predetermined information such as non-stopping floor information; and a transmission unit configured to periodically transmit a decided platform call registration permission signal to all of said operation control units, wherein each of said operation control units comprises:

a transmission unit configured to receive said platform call signal, which is inputted to said platform input unit provided on each floor, via said transmission line, and to transmit said platform call signal to other operation control units and said group control system using (a) simultaneous multiple addresses; and control means configured to light lamps of platform call buttons on the same floor.

4. A group controlled elevator control system as set forth in claim 1 or 2, which further comprises failure detecting means configured to monitor the status of transmission between said group control unit and a corresponding operation control unit ene of said operation control units to detect a failure therein, wherein said failure detecting means responds directly to said platform call registered by said platform call input unit, with a response being suspended to said assignment control signal, when a failure is detected.

5. A group controlled elevator control system as set forth in claim 1 or 2, wherein each of said operation control unit comprises:

arithmetic means configured to calculate a transmission time for transmitting a data from one of said operation control units to another control unit when said data is received and transmitted between said plurality of operation control units; and means configured to delay the output of a light signal for said lamps of said platform call buttons by said transmission time which is calculated by said arithmetic means.

6. A group controlled elevator control unit as set forth in claim 1 or 2, wherein each of said operation control units includes means configured to output a door opening signal for controlling the opening of a door by a corresponding one of said operation control units without transmitting said platform call input signal to other operation control units and said group control system, when a platform call button connected to a corresponding one of said operation control units having responded to said platform call when said door which is open in response to at least said platform call intends to be closed.

7. A group control elevator control system as set forth in claim 4, which further comprises a second transmission line for connecting said plurality of operation control units to each other in addition to a first transmission line for connecting said group control unit to said operation control units, wherein when said failure detecting means detects a transmitting failure between the group control system and the operation control units or between each of the operation control units, said group control unit stops receiving a platform call input signal from said first transmission line and uses said platform call input signal transmitted from said second transmission line to carry out an assignment.

8. A group controlled elevator control system as set forth in claim 7, wherein at least adjacent two of said plurality of platform call input/output units on the same floor are connected to each other as a pair via a back-up transmission line.

* * * * *

UNITED STATES PATENT AND TRADEMARK OFFICE

CERTIFICATE OF CORRECTION

PATENT NO. : 6,708,801 B2
DATED : March 23, 2004
INVENTOR(S) : Nakai

It is certified that error appears in the above-identified patent and that said Letters Patent is hereby corrected as shown below:

Column 13,
Line 33, change “of a one-car” to -- of the one-car --.

Column 14,
Line 6, change “using (a) simultaneous” to -- using simultaneous --.
Line 13, change “unit ene of” to -- unit of --.

Signed and Sealed this

Ninth Day of November, 2004

JON W. DUDAS
*Director of the United States Patent and Trademark Office*